US006110055A

United States Patent [19]

Wilson

[11] Patent Number: 6,110,055

[45] Date of Patent: Aug. 29, 2000

[54] GOLF CLUB

[75] Inventor: Geoffrey Wilson, Sheffield, United Kingdom

[73] Assignee: Tidymake Limited, United Kingdom

[21] Appl. No.: 09/194,135

[22] PCT Filed: May 29, 1997

[86] PCT No.: PCT/GB97/01456

§ 371 Date: Nov. 25, 1998

§ 102(e) Date: Nov. 25, 1998

[87] PCT Pub. No.: WO97/45172

PCT Pub. Date: Dec. 4, 1997

[30] Foreign Application Priority Data

May 31, 1996 [GB] United Kingdom ..... 9611357
Apr. 10, 1997 [GB] United Kingdom ..... 9707306

[51] Int. Cl.[7] ..... A63B 53/06; A63B 53/16

[52] U.S. Cl. ..... 473/239; 473/247; 473/295; 473/296; 473/307

[58] Field of Search ..... 473/231, 238, 473/239, 242, 244, 245, 247, 246, 248, 251, 295, 296, 307, 324

[56] References Cited

U.S. PATENT DOCUMENTS 1,982,087 11/1934 Wantz .
2,027,452 1/1936 Rusing .
2,146,048 2/1939 Barnhart .
3,539,185 11/1970 Andis .
3,663,019 5/1972 Palotsee .
4,878,666 11/1989 Hosoda ..... 473/247
5,083,779 1/1992 Ungermann .
5,385,346 1/1995 Carroll et al. .
5,496,029 3/1996 Heath et al. .

FOREIGN PATENT DOCUMENTS 12200 of 1913 United Kingdom .
751323 6/1956 United Kingdom .
899562 6/1962 United Kingdom .
2109249 1/1983 United Kingdom .
88/07880 10/1988 WIPO .

*Primary Examiner*—Jeanette Chapman
*Assistant Examiner*—Stephen L. Blau
*Attorney, Agent, or Firm*—Madson & Metcalf

[57] ABSTRACT

A golf club having a shaft (3) and a club head (2) which is connected to a shank portion (4) of the shaft at its heel end (31) so that it can be rotated around the axis of the shank portion. The configuration of the shank portion is such that the shaft axis and the shank axis intersect at about the bottom of the heel end of the club head so that rotating the club head around the shank axis causes the angle between the club face (30) and the shaft (3) to change.

15 Claims, 6 Drawing Sheets

100
1
2
3
4
5
6
7
8
9
21
22
23
25

52
51
54
54a 3
56

50
70
9
53
61
59
60
59
58
57
55

61a
59a
60a
59a
58a
57a

GOLF CLUB

BACKGROUND OF THE INVENTION

This invention relates to a golf club.

A golf club with an adjustable head can be used in place of two or more clubs with different head configurations. Most notably, variation in the angle between the face of the club head and the shaft can be adjusted to vary the degree of loft imparted to a ball when struck. Adjustable golf clubs suffer from the disadvantage that, through the design modifications necessary to incorporate adjustment, or through play between the adjustable components, the feel of the club to the player is unacceptably different from that of a conventional unadjustable club.

GB-A-2109249 discloses a golf club in which the loft of the head can be adjusted. The head can be fitted on an end portion of the shaft which is arranged at an angle to the main body of the shaft. The head can be rotated about the angled end portion. The effective angle between the club face and the shaft is altered as the club head is rotated about the cranked end.

The club disclosed in GB-A-2109249 suffers from the disadvantage that the feel to the player is unacceptably different from that of a conventional unadjustable club due to the requirement for the cranked end of the shaft for mounting the club head.

BRIEF SUMMARY OF THE INVENTION

The present invention provides a golf club in which the head is mounted on a shank portion at the end of the shaft. The head can be rotated around an axis defined by the shank portion, the axes defined by the shank portion and the shaft intersecting at about the bottom of the heel of the head.

Accordingly, in one aspect, the invention provides a golf club which comprises (a) a shaft with a shaft axis, the shaft having a shank portion with a shank axis, and (b) a head which has a heel end and a club face for contacting a golf ball when the club is swung in use, the head being attached to the shank portion of the shaft at its heel end so that it can be rotated around the shank axis, the configuration of the shank portion being such that the shaft axis and the shank axis intersect at about the bottom of the heel end of the club head so that rotating the club head around the shank axis causes the angle between the club face and the shaft to change.

The club of the present invention has the advantage of combining the properties of adjustment to provide different degrees of loft and a feel which more accurately reproduces the feel of a conventional golf club. The club of the invention can provide the player with a range of loft angles while maintaining a desired general location of the club head relative to the axis of the shaft.

Preferably, the shank portion is configured so that the angle between the shank axis and the vertical when the club is held in its intended position for striking a ball is less than about 30°, more preferably less than about 15°, especially less than about 10°. It is particularly preferred that the shank portion is configured so that the said angle is between 0° and 5°, so that the shank will often be substantially vertical when the club is held in its intended position for striking a ball.

Preferably, the angle between the shaft axis and the shank axis is at least about 5°, more preferably at least about 10°, especially at least about 15°, and at least about 20° for some applications. Preferably, the said angle is less than about 40°, more preferably less than about 30°, especially less than about 25°.

Preferably, the shank portion of the shaft is formed by bending an end portion of the shaft. More preferably, the shank portion of the shaft comprises a first section which defines the shank axis and a second section which extends between the shaft and the first section.

Generally, the angles between the first and second sections of the shank, and between the shaft and the second section of the shank, will be obtuse angles. Preferably, the angle between the first and second sections of the shank portion is less than the angle between the said second section and the shaft. The difference between the said angles is preferably at least about 5°, more preferably at least about 15°, especially at least about 25°. The difference between the said angles will preferably be less than about 40°, more preferably less than about 30°.

The golf club will generally include means for locking the club head against rotation about the shank axis.

The connection between the head and the shank portion can be provided by an assembly in which one of the head and the shank portion provides a spigot and the other of the head and the shank portion defines a bore, the head and the shank portion engaging one another by receipt of the spigot in the bore. Preferably, the spigot has (a) a first threaded portion for engaging a thread in the bore, (b) a second threaded portion which is threaded in the opposite sense to the first threaded portion, and (c) an internally threaded nut on the second threaded portion to lock the head against rotation relative to the shank portion.

Preferably, the pitch of the thread on the first threaded portion of the spigot is coarser than that of the thread on the second threaded portion. Conveniently, the thread on the first threaded portion is a multi-start thread, and that on the second threaded portion is a single-start thread. Such a combination of features can provide enhanced accuracy in adjustment of the club, in particular since small amounts of movement of the head can be controlled with relatively large movement of the nut.

Preferably, the club includes a blind tapped nut located in the bore and the spigot includes a third threaded portion which can engage the nut to lock the spigot in the bore.

The spigot might alternatively be internally threaded, and held in place in the bore by means of a threaded fastener such as a screw.

The locking means might be provided by collar portions on the head and the shank portion which (a) can be rotated relative to one another when axially separated, and (b) can be locked together against relative rotation when held axially against one another. The locking of the collar portions can be achieved by means of interlocking formations extending generally in the direction of the axis of the collar portions, for example in the form of castellations. The locking means can be provided by collar portions on the head and the shank portion and an intermediate collar located between the head and the shank portion, the head and the shank portion bearing formations which engage corresponding formations on the respective facing surfaces of the intermediate collar. The use of an intermediate collar in this way can enable more precise control to be obtained over the adjustment of the club head, for example by providing different spacings between formations on the head and the shank portion respectively (and the corresponding facing surfaces of the intermediate collar).

Preferably, the length of the shaft is adjustable. This has the advantage of allowing the feel of the club to be optimised following an adjustment to the loft. It also has the significant advantage of allowing the club to be collapsed to a compact configuration, for example for convenient transportation. This advantage can be important in circumstances such as when golf equipment is to be transported in a vehicle in which there is little space, for example in a car or in a vehicle.

The shaft might comprise an inner portion and an outer portion, the inner portion being slidable telescopically within the outer portion to adjust the length of the shaft. There might be more than two portions which are capable of sliding telescopically in this way.

The club can include a resiliently deformable member arranged around the inner portion of the shaft, between the inner portion and the internal wall of the outer portion. Such a deformable member can support the inner and outer portions, minimising transverse relative movement between the inner and outer members.

Preferably, the club includes locking rings positioned around the resiliently deformable member, by which the member can be axially compressed to increase its transverse dimension, to engage the inner and outer portions of the shaft.

Preferably, the resiliently deformable member comprises a tube formed from an elastic material. Preferably, the locking rings comprise a plurality of rings formed from a non-resilient material, generally a polymeric material.

When it is adjustable in length, the shaft preferable bears markings which enable the shaft to be pre-set at a predetermined desired length.

BRIEF SUMMARY OF THE SEVERAL VIEWS OF THE DRAWINGS

The invention will now be further described by way of example only with reference to the accompanying drawings in which.

DETAILED DESCRIPTION OF THE INVENTION

Figures 1, 2, 2A, 2B, 2C:
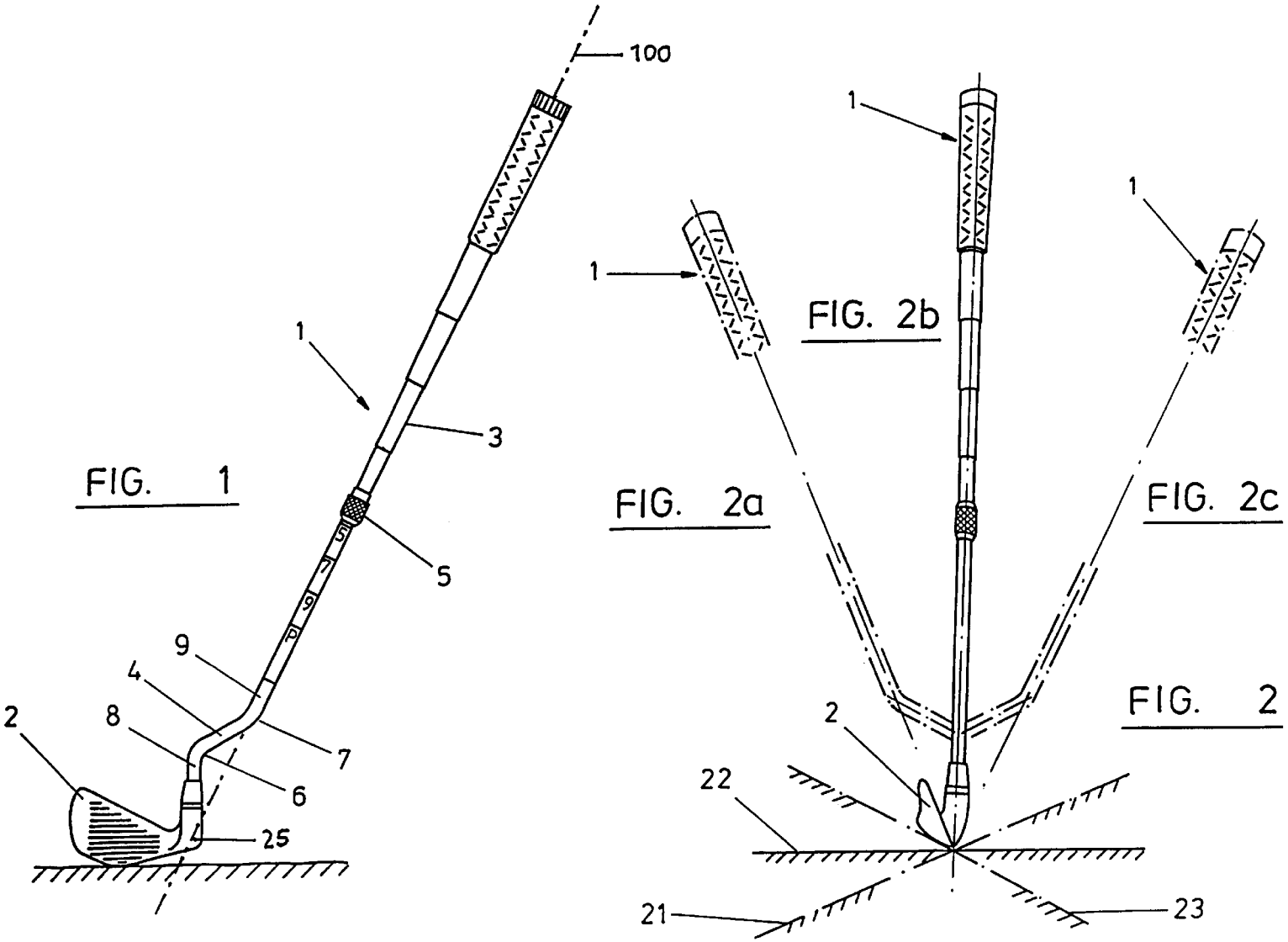
FIG. 1 is a schematic representation of an adjustable golf club according to the present invention.
FIGS. 2*a*, 2*b* and 2*c* are each schematic representations of a golf club of FIG. 1 showing the golf club in each of three working positions.

Referring to the drawings, FIG. 1 shows a golf club 1 which comprises a golf club head 2 connected to a shaft 3 by means of a shank portion 4. The golf club has a shaft length set in mid position by adjustment means 5 described in more detail below.

The shank portion 4 is formed by bending a shaft. A first section of the shank portion 8 defines an axis and engages the head. A second section extends between the first section 8 and the shaft 3. The shaft with its shank portion defines elbows 6 and 7. The angle at the elbow 6 between the first and second section of the shank portion is smaller than the angle at the elbow 7 between the second section of the shank portion and the first section.

The golf club 1 is shown in three working positions in FIGS. 2*a*, 2*b* and 2*c*. In FIG. 2*a*, the golf club head 2 is adjusted to a minimum locked position for use in putting. Ground level is indicated by reference numeral 21.

FIG. 2*b* shows the club head 2 adjusted to mid locked position which is equivalent to a 5 iron conventional club. The associated ground level is indicated by reference numeral 22.

FIG. 2*c* shows the club head 2 adjusted to a maximum locked position equivalent to the wedge in a set of conventional unadjustable golf clubs. The associated ground level is indicated by reference numeral 23.

Figures 3, 3A, 3B:
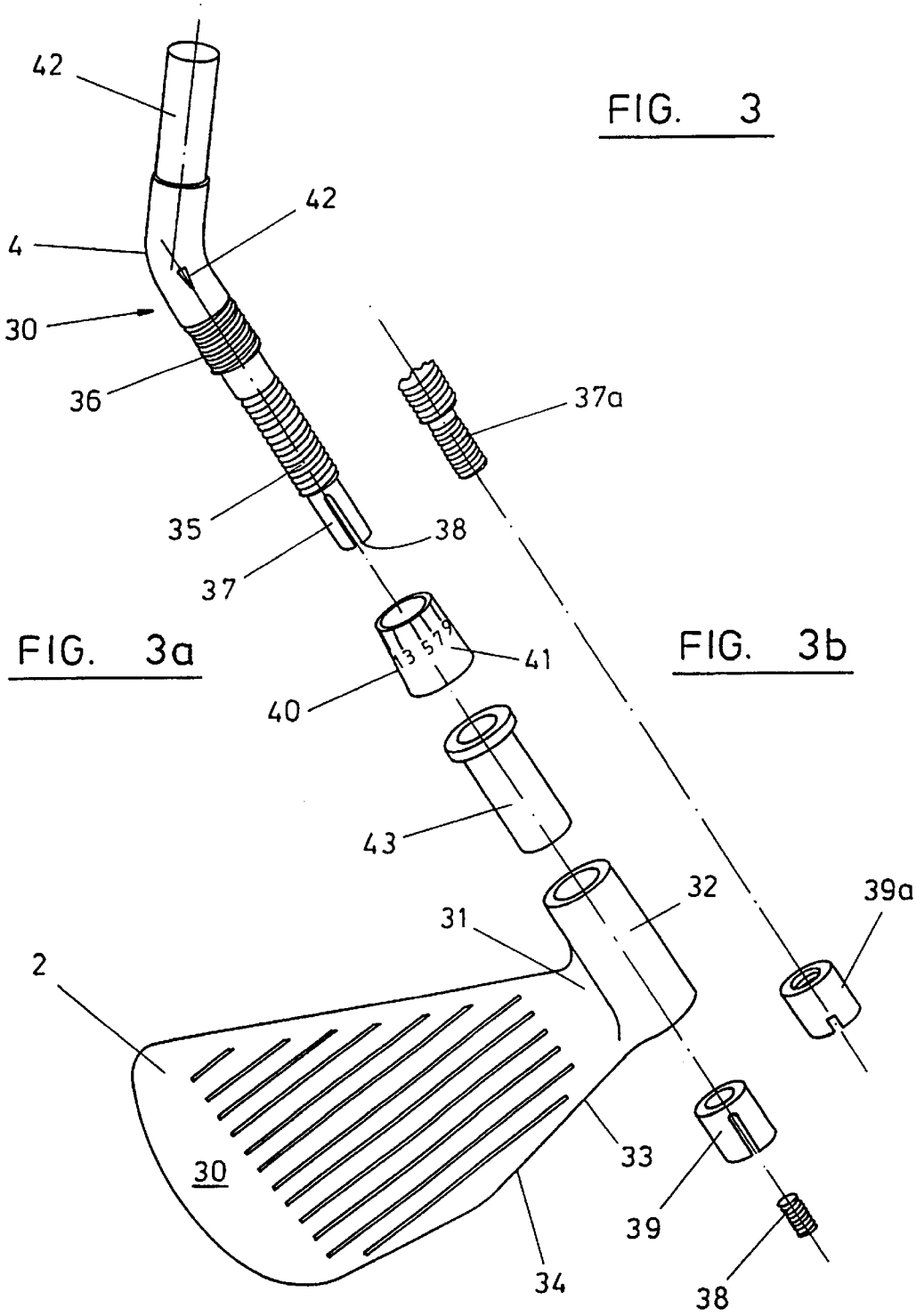
FIGS. 3*a* and 3*b* are exploded representation of a lower portion of the golf club of FIG. 1 showing the golf club head assembly.

Embodiments of the head assembly of the club 1 of FIG. 1 are shown in FIGS. 3*a* and 3*b* in an exploded view. The assembly comprises a head 2 which comprises a face 30 and a heel portion 31 in which a bore 32 is formed. The heel portion has a first end and a second end. The face 30 further comprises a sole 33 which is angled so that a centre portion 34 of the sole 33 makes contact with the ground when the club is used, even with a small angular rotation of the face.

The golf club head 2 is attached to the shaft 3 by means of a shank portion 4. The shank portion 4 comprises a first threaded portion 35 and a second threaded portion 36. The shank 4 is shaped to fit in the bore 32 in the head, and is kept in place by means of a tapped bush 43 which itself fits into the bore 32 and is fixed therein, for example by means of an adhesive. The tapped bush 43 can mate with the first threaded 35 of shank 4. The end portion 37 of shank 4 has a plain diameter which is slit along its length to a bore positioned substantially at the centre of the end portion 37. The bore in the end of the shank is tapped to accept a tapered screw 38. When the shank 4 is positioned in the bore 32 in the head, the end portion 37 of the shank is held in position within the bore 32 by means of a split bush 39 and a screw 38.

By adjusting the length of engagement of the screw 38 with the end portion 37, the amount of frictional resistance to rotation between shank 4 and head 2 can be adjusted.

Referring to FIG. 3*b*, a golf club head is shown in which the end portion 37 and split bush 39 of the FIG. 3*a* embodiment have been replaced by a third threaded portion 37*a* and a lock nut 39*a* respectively. The third threaded portion 37*a* mates with the lock nut 39*a* locks the shank 4 to the head 2 which when rotated to locate against the smaller diameter end of bush 43. The lock nut 39*a* has a suitable slot for locating a disc or coin for tightening.

In the FIG. 3*b* embodiment, the tapped bush 43 is locked between the conical nut 40 and the split bush 39 . However, because of the natural clearances required between male and female thread forms, a small amount of rotation of the tapped bush 43 might occur in adverse circumstances. This movement is commonly known as "back lash".

Figure 3C:
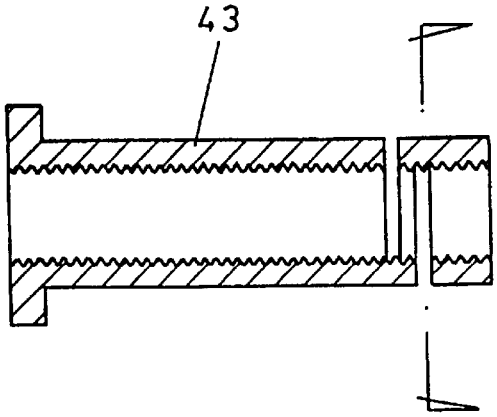
FIGS. 3*c*, 3*d* and 3*e* are schematic representations of further embodiments of a tapped bush suitable for use in the golf club of FIG. 3*b;*
Figure 3E:
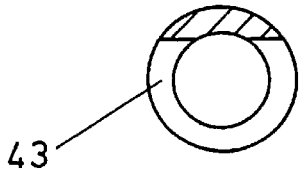

It is possible to reduce back lash by forming two slots in the tapped bush 43 as shown in FIGS. 3*c* and 3*e*. This ensures contact between both sides of the threaded portion 35 and tapped bush 43. Under an axial force from the conical nut 40 and/or from the lock nut 39*a*, the centre portion between the two slots will bend, marginally shortening the overall length split bush 43, until contact is made with both sides of the threaded portion 35 of shank 4.

Figure 3D:
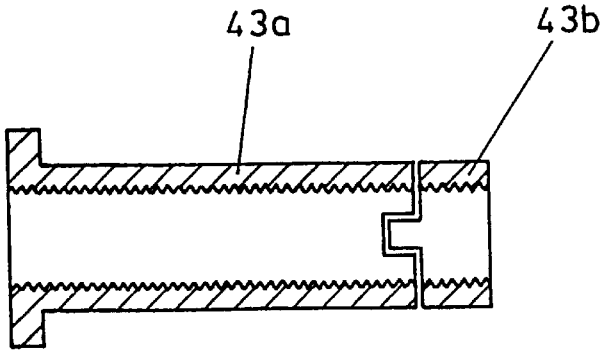

Alternatively, the split bush 43 may be formed in first and second bush parts 43*a*, 43*b* as shown in FIG. 3*d*. Again, this ensures contact between both sides of first threaded portion 35 and the tapped bush 43. In use, the first threaded portion 35 will enter the second bush part 43*b* but will not protrude through the end. This enables the lock nut 39*a* to urge the second bush part 43*b* towards the first bush part 43*a* and provide contact on both sides of the threaded portion 35 of the shank 4.

Referring again to FIGS. 3*a* and 3*b*, the threaded portion 36 is shaped to mate with a similar thread form formed within the conical nut 40. The outer surface 41 of the nut 40 is marked with calibration markings.

The second threaded portion 36 is a right hand thread form, and the first threaded portion 35 is a multi-start left hand thread form. The thread directions of threaded portions 35, 36 are for right handed players. The directions of threads would be reversed for left handed players.

The end portion 42 of the shank portion 4 connected to the shaft 3, either by being formed integrally with the shaft (for example by bending the end of the shaft to create the shank portion) or by a joining technique (for example a mechanical joining technique or by welding, brazing or by means of a bonding agent). The end portion 42 has a reduced diameter to allow adhesive fixing of the shank 4 into the bore of a tube 70 (see FIG. 4) which forms the shaft. Both shank 4 and tube 70 are formed with elbows 6, 7 which are in opposite senses to one another.

In order to adjust the angle of the golf club head relative to the shaft, conical nut 40 may be rotated the desired amount measured by the calibration markings 41.

From FIG. 1 is can be seen that if the axis 100 of shaft 3 is extended downwards it intersects with through a point 25 positioned towards the second heel end of the club head 2, the second shank axis or bore axis. Assume that the angle between the horizontal ground and the shaft 3 is 60° and the bore axis is vertical, then rotating the shaft 3 around the bore axis will result in loft angle as follows.

1. Assume shaft 3 is rotated 90° from the mean position in an anticlockwise direction as shown FIG. 2*a*, then from an initial position 2*b* where the loft is about 30° the loft will change to 30°−[90°−60°], that is to 0° loft.
2. If the shaft is then rotated from the mean position in a clockwise direction the loft will increase to 30°+[90°−60°], that is to 60° loft.

Intermediate angles of loft can be achieved by rotating the shaft 3 about the bore axis to an appropriate position.

Typical relative position are as follows:

| Club | Loft | Shaft Position |
|---|---|---|
| Driving iron | 17° | 22° |
| 3 | 20° | 17° |
| 4 | 23° | 12° |
| 5 | 26° | 7° |
| 6 | 29° | 2° |
| [mean] | 30° | 0° |
| 7 | 32° | 3° |
| 8 | 35° | 8° |
| 9 | 39° | 15° |
| Pitching wedge | 43° | 22° |
| General wedge | 50° | 40° |

Typical shaft rotation is 5° between each club selection. In order to provide an easy to read calibration a twin screw assembly is used as follows.

Thread 35 and thread 36 are both located on the shaft which through the bore.

Thread 35 is a left handed multi start thread e.g. 4 start, 5 mm lead whilst thread 36 is a right handed single start thread, for example 1 mm pitch.

This combination of left and right handed threads provide a locking action when a force is applied to the face of the club head for right handed players. Appropriate reversal of features will be required for left handed players.

Because of the difference in pitch length between the shaft rotating in the bore bush and the nut 40 small angular rotation of the shaft 3 about the bore axis can be obtained from significantly larger angular rotation of the calibrated locking nut 40.

For example, typical angular rotation of the shaft 3 about the bore centre-line from say a No 6 Iron to a No 7 Iron is 5°. However, the angle of the rotation of the nut 40 relative to the shaft is magnified by the ratio of 5 mm lead to 1 mm pitch ie 5:1 therefore the angle of rotation of the nut 40 to achieve a loft change from a No 6 Iron to a No 7 Iron is 5×50=25°.

In order to provide a full range of club selection positions the nut 40 carries a suitable range of calibrated marks 41 which when aligned against a fixed mark 42 on the shaft knuckle 4 provides the required loft angle when the bush 43, and hence the club head, is rotated to meet the nut 40.

Referring to FIGS. 4*a* to 4*d*, further parts of the golf club are shown in more detail. The shaft comprises upper and lower tube sections. The end portion 9 of tube 70 is attached to the smaller end of the shaft 3 at the bottom of the lower tube section 51 by means of a hollow tube 53, which is shaped to fit internally within the tube section. The larger diameter end 54 of the lower tube section 51 is split and flared to provide location for the lower tube section 51 as it slides inside upper tube section (which also has a stepped bore). The upper section of the shaft 3 has a hand grip 56 on one end. At the other end of upper section 3 a second adjustment means in the form of a shaft locking device 57 is mounted. The shaft locking device comprises a body 58 provided internally with two anti-expansion rings 59 spaced on either side of an elastic tube 60. In operation the lower tube section passes through the bore of the rings 59 and the nut 61 freely when the elastic tube 60 is in free state. The nut 61 is provided with a screwed portion to engage with a mating internal thread in the body 58 and provide clamping means to the elastic tube 60. When clamped longitudinally, the elastic tube 60 provides radial pressure to the external surface of the tube section 51 and the internal surface of body 58 and so locks the two against movement.

Figures 4A, 4B, 4C, 4D:
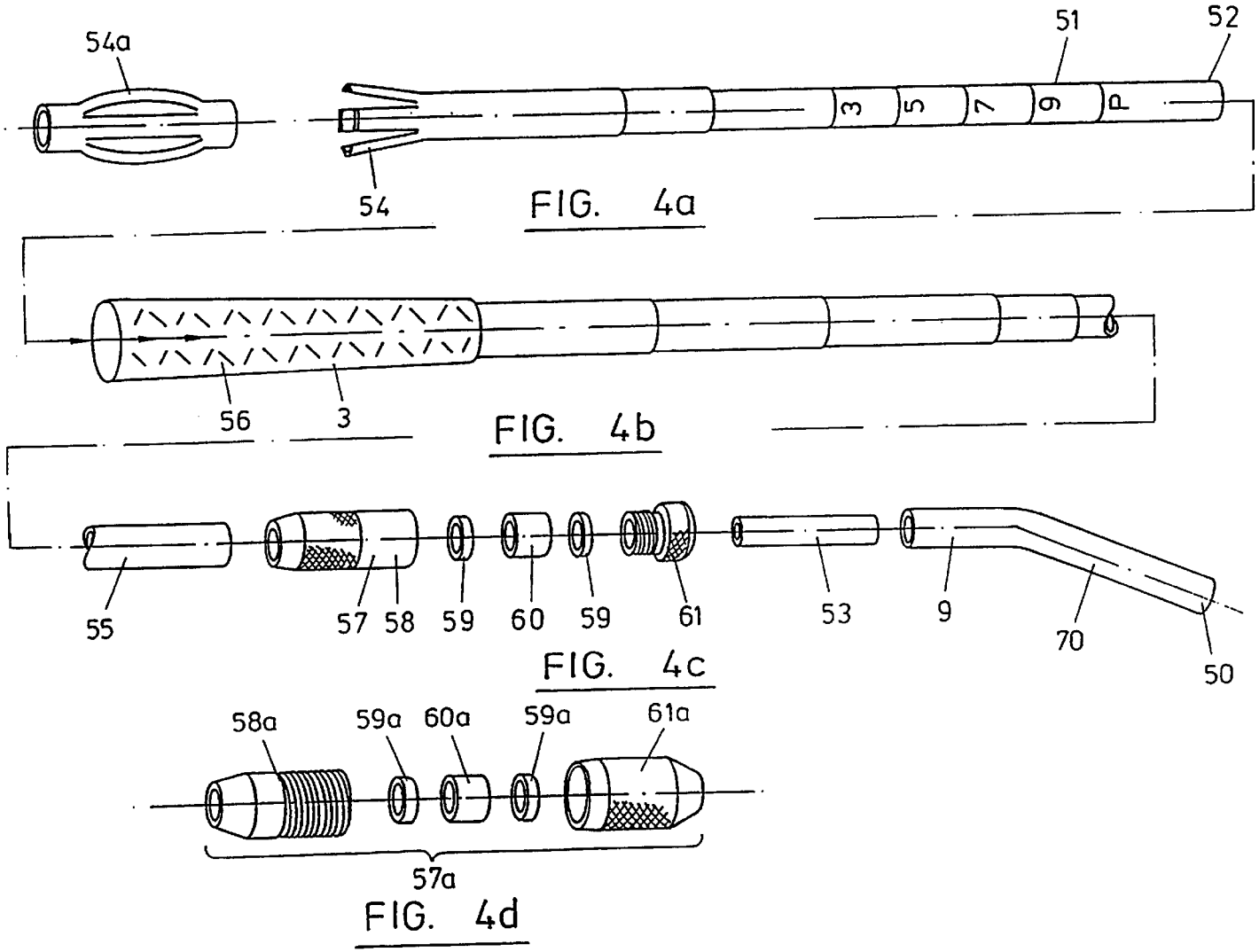
FIGS. 4*a*, 4*b*, 4*c* and 4*d* are exploded representations of the shaft of a golf club according to the invention.

Referring to FIG. 4*d*, an alternative locking device 57*a* is shown where internal rings 59 and a flexible tube 60 are equivalent to those in locking device 57 shown in FIG. 4*c*. A nut 61*a* is provided with an internal thread to mate with an external threaded portion on the body 58*a*.

FIG. 4*a* shows a separate flared tube 54*a* which can be used optionally in place of the flared end 54 of the tube section 51. The flared tube is produced from appropriately size tube longitudinally split in several positions around the diameter and along the centre portion length of the tube. The centre tube is then increased in diameter to form a "barrel" spring which locates shaft 51 as it slides inside shaft 55.

In order to adjust the length of the shaft, a shaft locking device 57 may be relaxed by unscrewing nut 61 to release the clamping force on flexible tube 60. With the locking device relaxed, shaft portion 51 can be slid within shaft portion 55 until the required shaft length has been obtained. This is indicated by calibration marks marked on the outer surface of shaft portion 51. Once the required length has been obtained locking device 57 is operated by tightening nut 61.

Figure 5A:
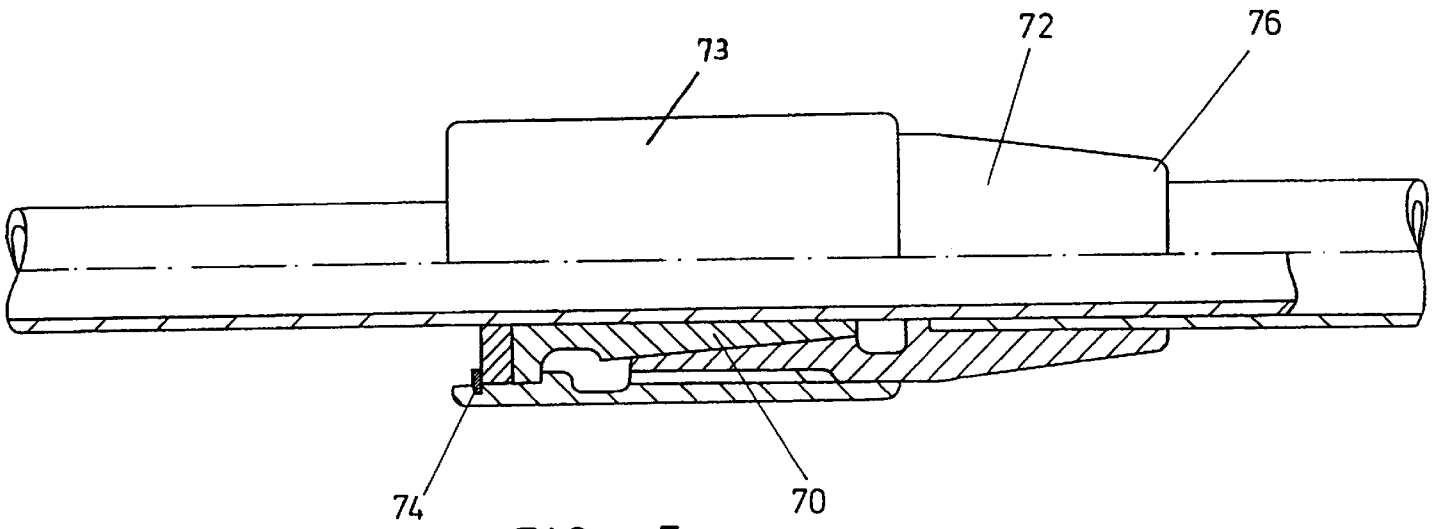
FIGS. 5*a*, 5*b* and 5*c* are schematic representations of a collet in a further embodiment of the invention in which the collet serves as a second adjustment means.
Figure 5C:
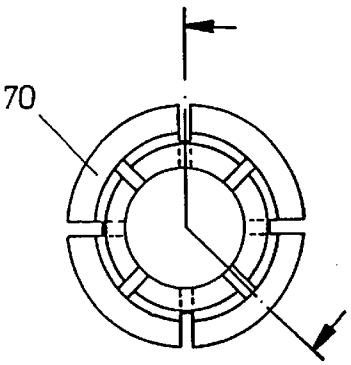
Figure 5B:
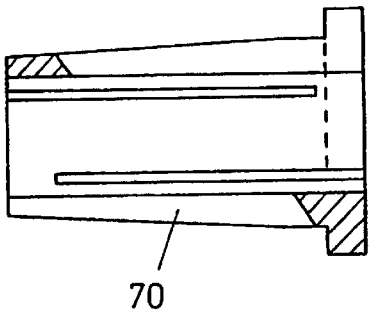

Referring to FIGS. 5*a*, 5*b* and 5*c*, a further alternative locking device for a telescoping shaft is shown. The locking device comprises a split collet. The collet 70 is split at both ends and is highly resilient as a result. The split collet 70 is arranged to fit inside a conical sleeve 72 is attached to the upper shaft and which has a tapered bore with its smaller diameter end pointing towards the upper shaft. The split collet is held in place in an outer sleeve 73 by a circlip 74. Movement of the outer and conical sleeves towards one another causes inward deformation of the collet into contact with the surface of the lower shaft, to hold the upper and lower shafts axially relative to one another.

Figure 6:
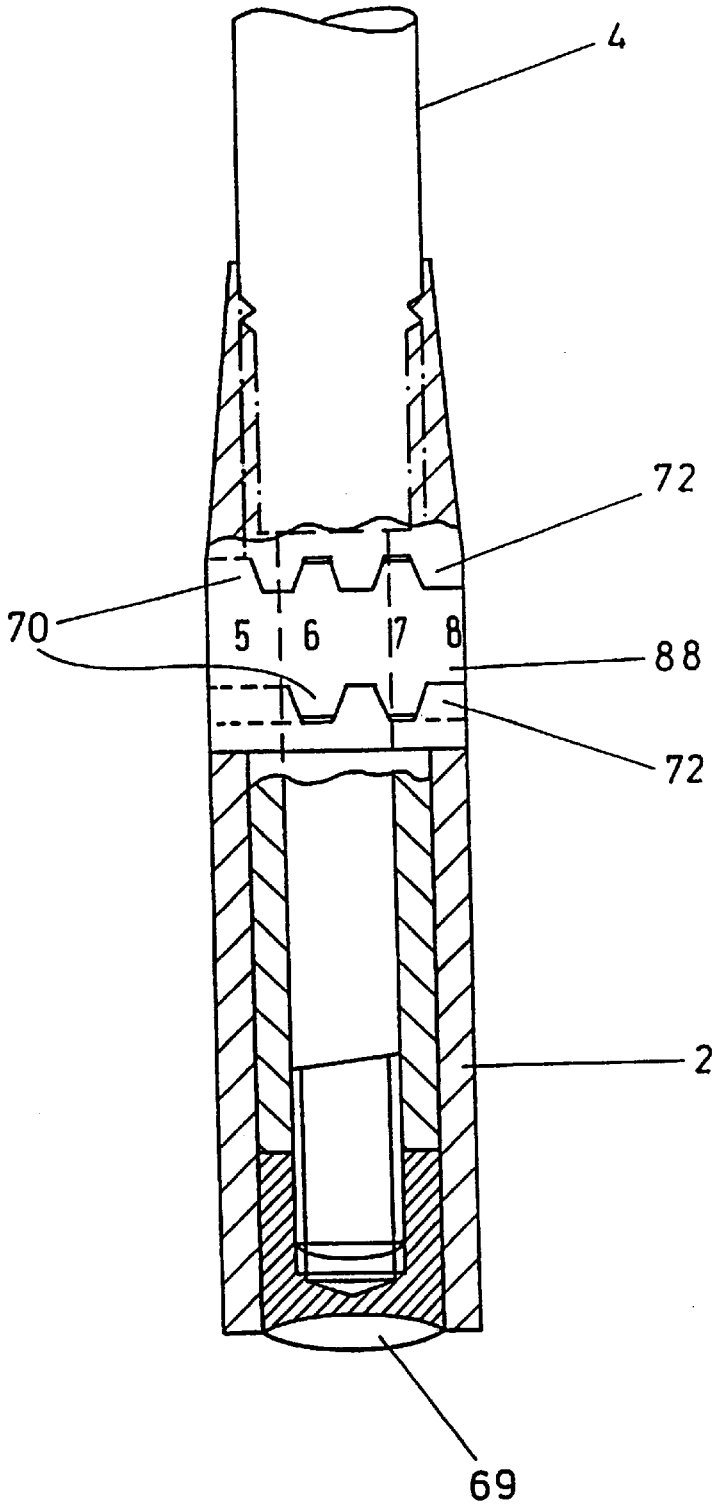
FIG. 6 is a side view, partially in section, of the lower of portion of another embodiment of golf club.

FIG. 6 shows an alternative locking arrangement for the joint between the head 2 and the shank 4 which can be incorporated in the club shown in FIG. 1 in place of the components shown in FIG. 3. As in the FIG. 3 construction, the shank extends through a bore in the head and is fastened therein by means of a fastener 69 at its lower end. The locking arrangement comprises castellated collar portions 72 on the head 2 and the shank portion 4, and an intermediate collar 88 which bears castellations 70 corresponding to the castellations 72 on the head and the shank with which they interfit. The spacings between the castellations on the head and the shank portion respectively (and the corresponding facing surfaces of the intermediate collar) are different, allowing a greater range of degrees of rotation of the head around the shank.

Adjustment of the collar arrangement is achieved by loosening the fastener 69 allowing the shaft to be withdrawn partially from the bore in the head and the collar portions 72 on the head and the shaft and the intermediate collar 88 to be separated axially. The collar portions and the intermediate collar can then be rotated relative to one another before being pushed together axially and fastened together axially by means of the fastener 69.

What is claimed is:

1. A golf club which comprises (a) a shaft with a shaft axis, (b) a head which has a heel end and a club face for contacting a golf ball when the club is swung in use, and (c) a shank which has first and second sections, in which the first shank section defines a shank axis with the head being attached at its heel end to the first shank section so that it can be rotated around the shank axis, and in which the second shank section extends between the shaft and the first shank section, the configuration of the first and second shank sections being such that the shaft axis and the shank axis intersect at about the bottom of the heel end of the club head, so that rotating the club head around the shank axis causes the angle between the club face and the shaft to change, the shank being configured so that the first shank axis is substantially vertical when the club is held in its intended position for striking a ball.

2. A golf club as claimed in claim 1, in which the shank of the shaft is formed by bending an end portion of the shaft.

3. A golf club as claimed in claim 2, in which the angle between the first and second sections of the shank is less than the angle between the said second section and the shaft.

4. A golf club as claimed in claim 3, which includes means for locking the club head against rotation about the shank axis.

5. A golf club as claimed in claim 4, in which one of the head and the shank provides a spigot and the other of the head and the shank portion defines a bore, the head and the shank portion engaging one another by receipt of the spigot in the bore.

6. A golf club as claimed in claim 5, in which the spigot has (a) a first threaded portion for engaging a thread in the bore, (b) a second threaded portion which is threaded in the opposite sense to the first threaded portion, and (c) an internally threaded nut on the second threaded portion to lock the head against rotation relative to the shank portion.

7. A golf club as claimed in claim 6, in which the pitch of the thread on the first threaded portion of the spigot is coarser than that of the thread on the second threaded portion.

8. A golf club as claimed in claim 7, in which the length of the shaft is adjustable.

9. A golf club as claimed in claim 8, in which the shaft comprises an inner portion and an outer portion, the inner portion being slidable telescopically within the outer portion to adjust the length of the shaft.

10. A golf club as claimed in claim 9, which includes a resiliently deformable member arranged around the inner portion of the shaft, between the inner portion and the internal wall of the outer portion.

11. A golf club as claimed in claim 1, in which the shank of the shaft is formed by bending an end portion of the shaft.

12. A golf club as claimed in claim 1, in which the angle between the first and second sections of the shank is less than the angle between the said second section and the shaft.

13. A golf club as claimed in claim 1, which includes means for locking the club head against rotation about the shank axis.

14. A golf club as claimed in claim 1, in which one of the head and the shank portion provides a spigot and the other of the head and the shank portion defines a bore, the head and the shank engaging one another by receipt of the spigot in the bore.

15. A golf club as claimed in claim 1, in which the length of the shaft is adjustable.

* * * * *

UNITED STATES PATENT AND TRADEMARK OFFICE

CERTIFICATE OF CORRECTION

PATENT NO. : 6,110,055
DATED : August 29, 2000
INVENTOR(S) : Geoffery Wilson

It is certified that error appears in the above-identified patent and that said Letters Patent is hereby corrected as shown below:

Column 8,
Lines 12, 13, 45 and 46, please delete "shank portion" and replace it with -- shank --.

Signed and Sealed this

Third Day of September, 2002

*Attest:*

*Attesting Officer*

JAMES E. ROGAN
*Director of the United States Patent and Trademark Office*